US009238246B2

(12) United States Patent
Surratt et al.

(10) Patent No.: US 9,238,246 B2
(45) Date of Patent: Jan. 19, 2016

(54) ILLUMINATED HANDLE ASSEMBLY

(71) Applicants: Cubby Surratt, Lexington, NC (US); Theresea Surratt, Lexington, NC (US)

(72) Inventors: Cubby Surratt, Lexington, NC (US); Theresea Surratt, Lexington, NC (US)

( * ) Notice: Subject to any disclaimer, the term of this patent is extended or adjusted under 35 U.S.C. 154(b) by 151 days.

(21) Appl. No.: 14/196,246

(22) Filed: Mar. 4, 2014

(65) Prior Publication Data

US 2015/0251210 A1 Sep. 10, 2015

(51) Int. Cl.

| | |
|---|---|
| ***B05C 17/02*** | (2006.01) |
| ***B25G 1/04*** | (2006.01) |
| ***B25G 3/36*** | (2006.01) |
| ***F21V 33/00*** | (2006.01) |
| *F21W 111/10* | (2006.01) |

(52) U.S. Cl.

CPC ..... *B05C 17/0245* (2013.01); *B05C 17/02* (2013.01); *B05C 17/0205* (2013.01); *B25G 1/04* (2013.01); *B25G 3/36* (2013.01); *F21V 33/0084* (2013.01); *F21W 2111/10* (2013.01)

(58) Field of Classification Search

CPC B05C 17/0245; B05C 17/02; B05C 17/0205; F21V 33/0084; B25G 1/04; B25G 3/36; F21W 2111/10

See application file for complete search history.

(56) References Cited

U.S. PATENT DOCUMENTS

| | | | | |
|---|---|---|---|---|
| 2,778,043 | A * | 1/1957 | Arf | A47L 23/06 15/105 |
| 4,480,295 | A | 10/1984 | Shuster | |
| 4,916,773 | A | 4/1990 | McCoy | |
| 6,116,747 | A | 9/2000 | Grawemeyer et al. | |
| 6,454,428 | B1 | 9/2002 | Bruzon | |
| 7,096,530 | B2 * | 8/2006 | Goulet | B05C 17/0205 15/144.4 |
| 7,178,934 | B2 | 2/2007 | McInnis | |
| D662,116 | S | 6/2012 | Harden et al. | |
| 2006/0147256 | A1 * | 7/2006 | Richardson | B25G 1/06 403/91 |
| 2006/0215391 | A1 * | 9/2006 | Jones | A46B 15/0002 362/91 |
| 2008/0266845 | A1 * | 10/2008 | Wu | B25B 15/02 362/157 |
| 2012/0227197 | A1 | 9/2012 | Fleischer | |

* cited by examiner

*Primary Examiner* — Alan Cariaso

(57) ABSTRACT

An illuminated handle assembly for attaching to a paint roller includes a top handle that is removably coupled to the paint roller. A primary handle is coupled to the top handle so the primary handle is coupled to the paint roller. A plurality of light emitters is each coupled to the primary handle. The plurality of light emitters directs a beam of light toward the paint roller. Each of the plurality of light emitters is operationally independent from one another. An actuator is coupled to the primary handle. The primary actuator is operationally coupled to each of the plurality of light emitters. The actuator selectively actuates the plurality of light emitters.

16 Claims, 6 Drawing Sheets

ILLUMINATED HANDLE ASSEMBLY

BACKGROUND OF THE DISCLOSURE

Field of the Disclosure

The disclosure relates to illuminated handle devices and more particularly pertains to a new illuminated handle device for attaching to a paint roller.

SUMMARY OF THE DISCLOSURE

An embodiment of the disclosure meets the needs presented above by generally comprising a top handle that is removably coupled to the paint roller. A primary handle is coupled to the top handle so the primary handle is coupled to the paint roller. A plurality of light emitters is each coupled to the primary handle. The plurality of light emitters directs a beam of light toward the paint roller. Each of the plurality of light emitters is operationally independent from one another. An actuator is coupled to the primary handle. The primary actuator is operationally coupled to each of the plurality of light emitters. The actuator selectively actuates the plurality of light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
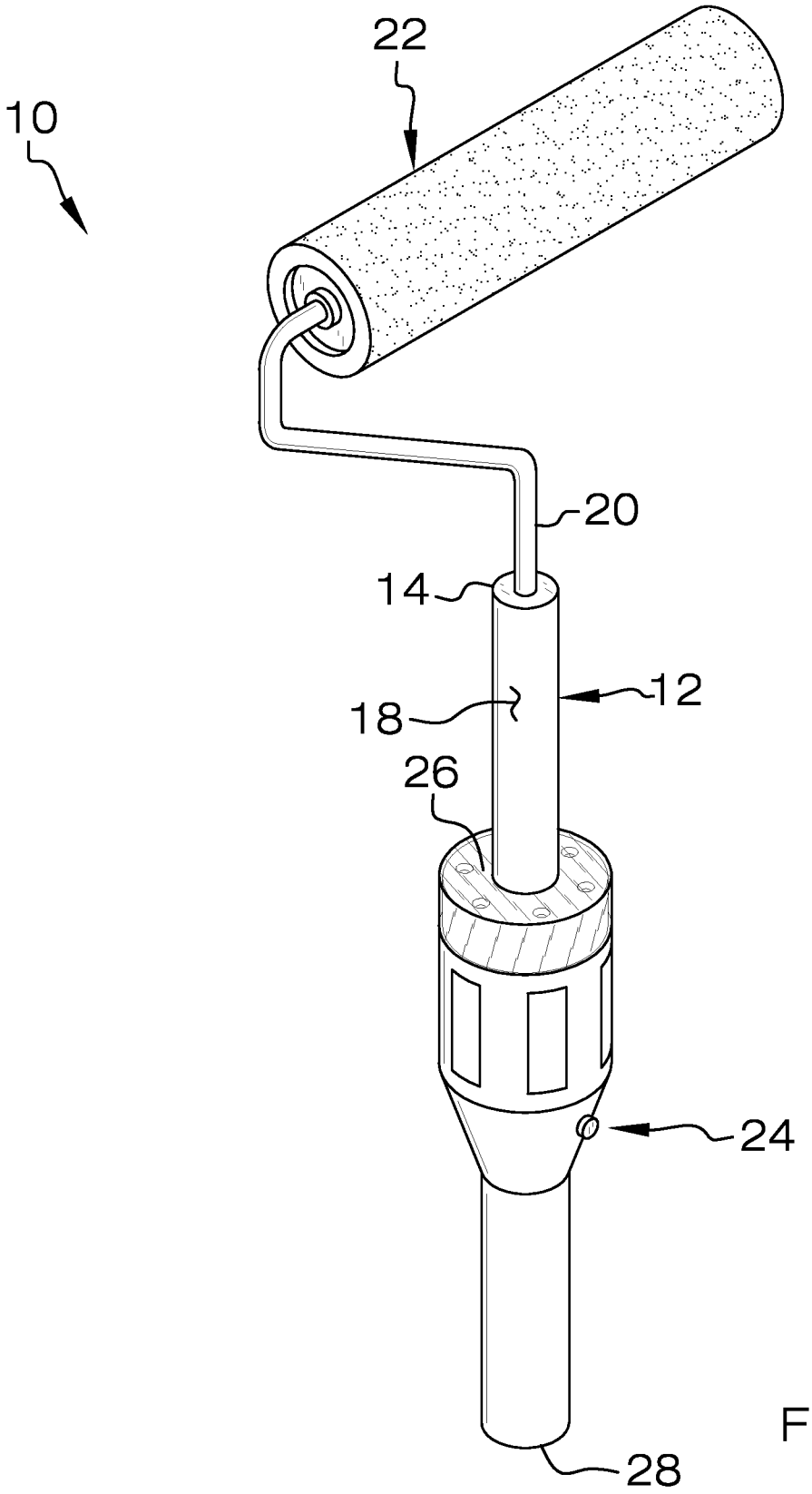
FIG. 1 is a perspective view of a illuminated handle assembly according to an embodiment of the disclosure.
Figure 2:
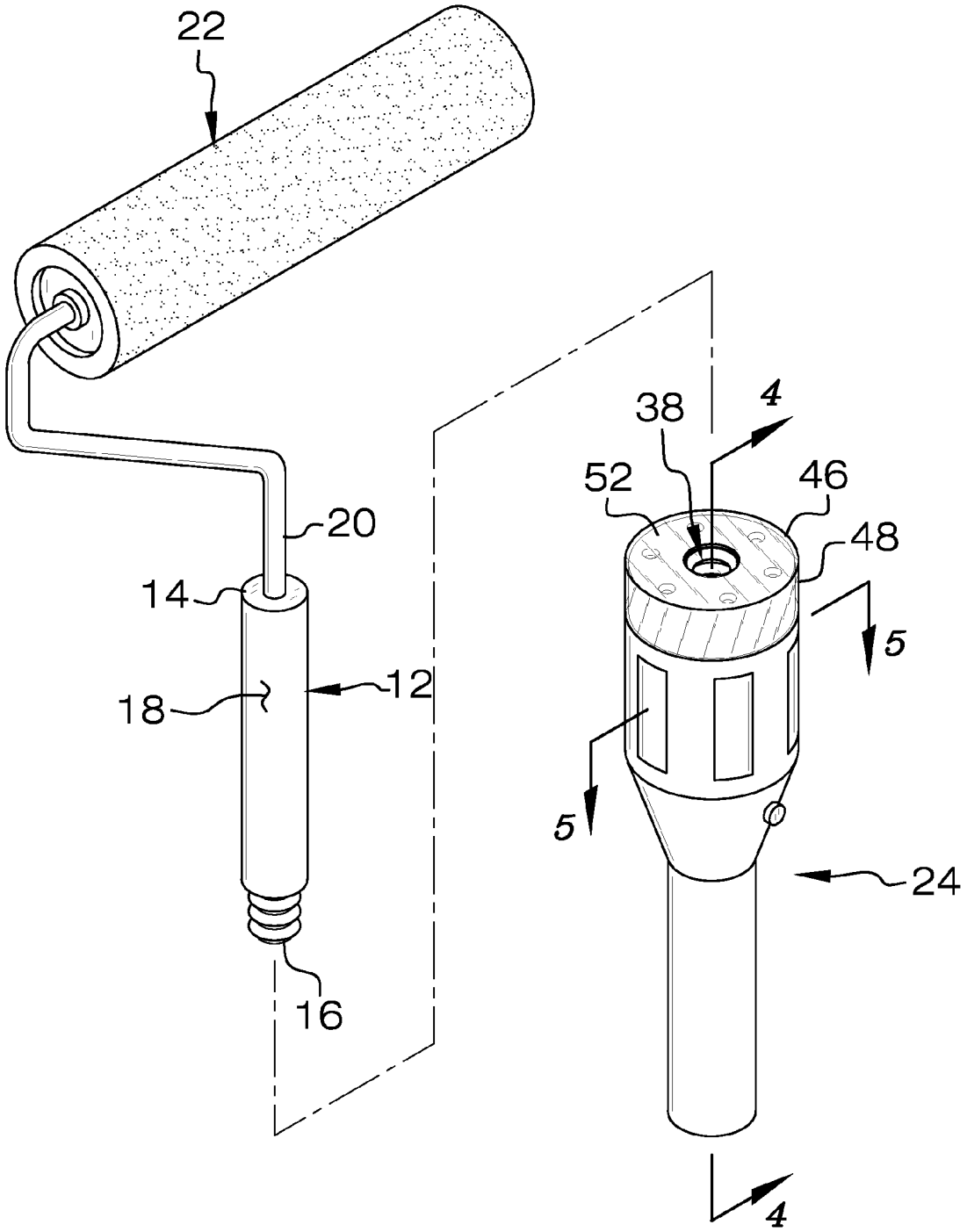
FIG. 2 is an exploded perspective view of an embodiment of the disclosure.
Figure 3:
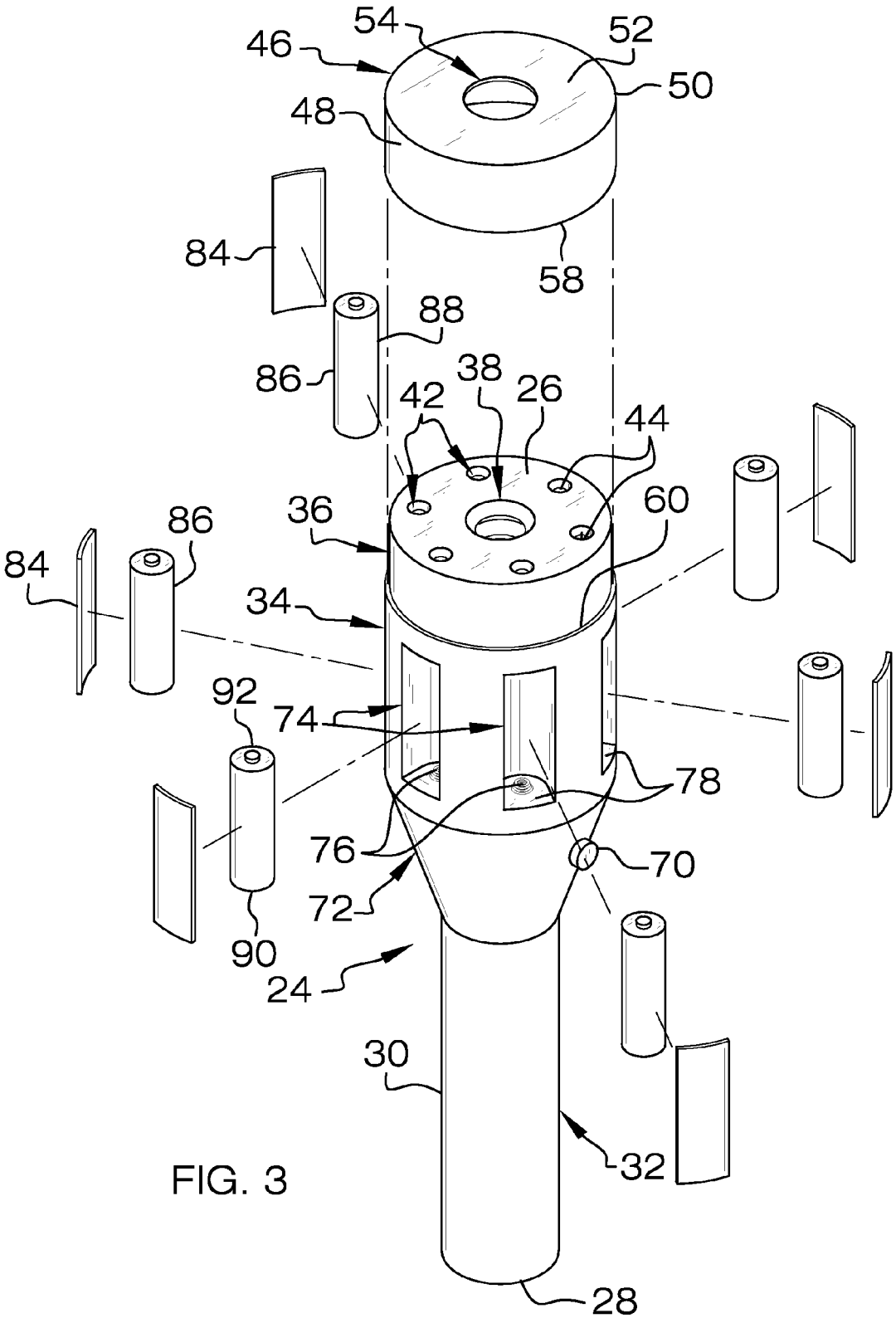
FIG. 3 is an exploded top perspective view of an embodiment of the disclosure.
Figure 4:
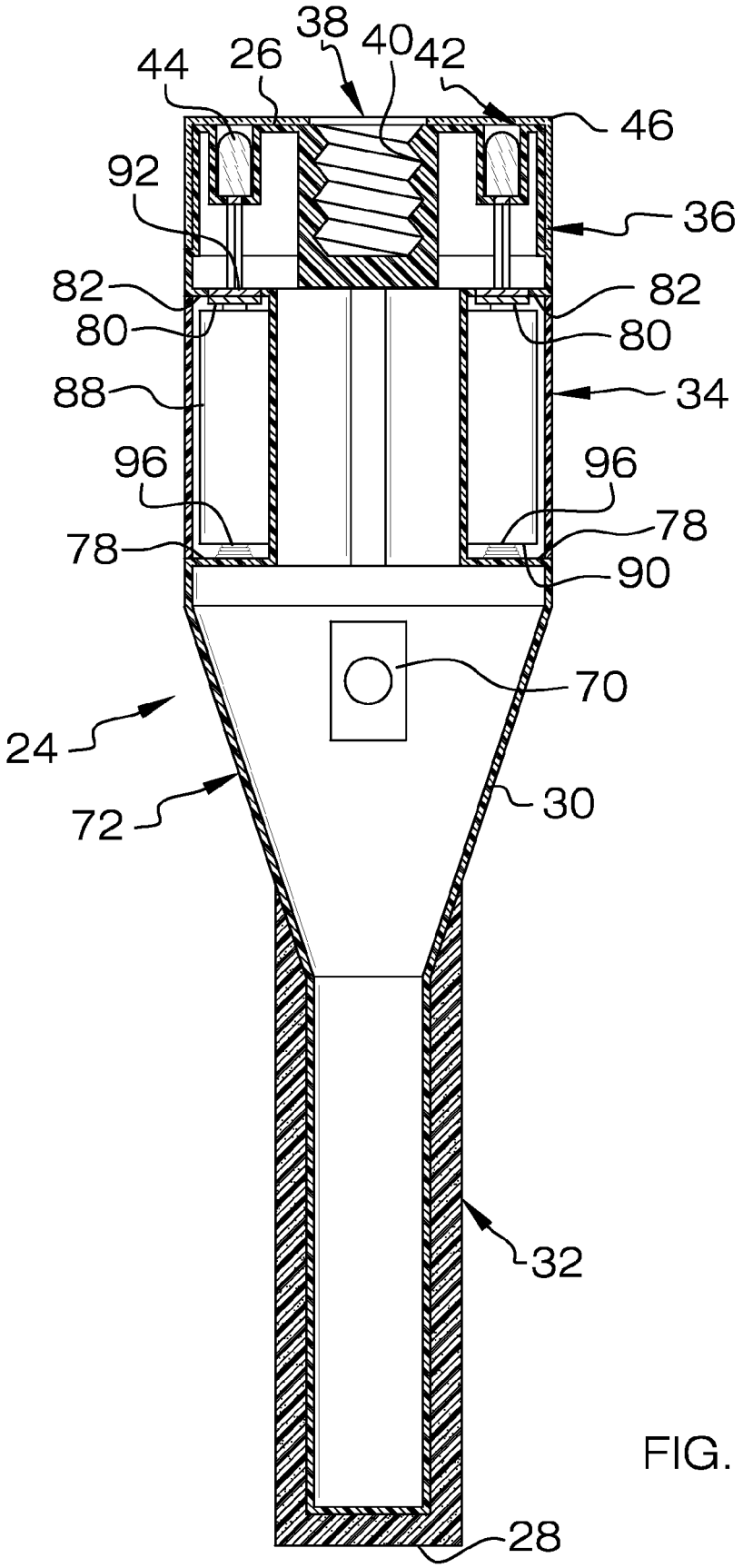
FIG. 4 is a cross sectional view taken along line 4-4 of FIG. 2 of an embodiment of the disclosure.
Figure 5:
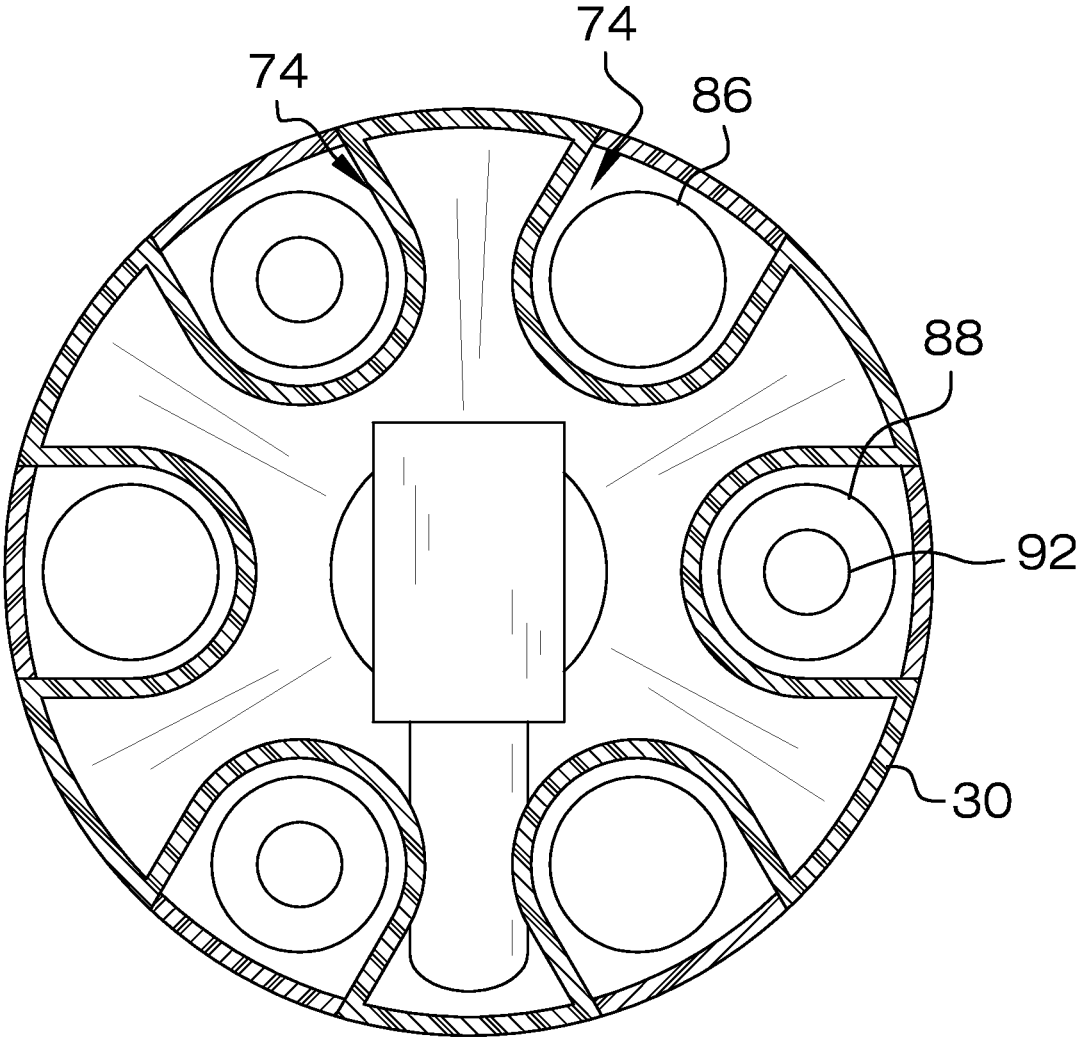
FIG. 5 is a cross sectional view taken along line 5-5 of FIG. 2 of an embodiment of the disclosure.
Figure 6:
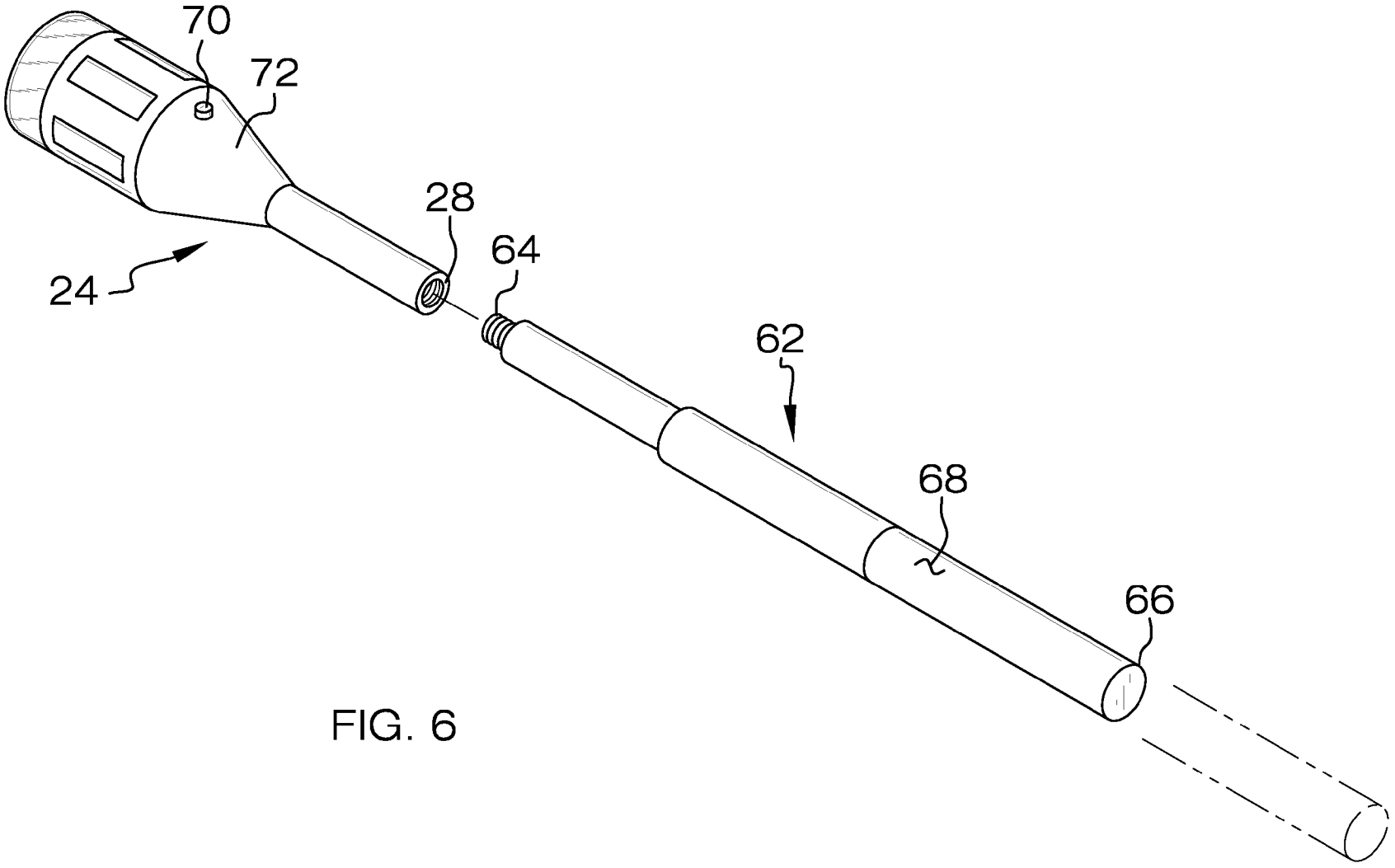
FIG. 6 is a bottom perspective view of an embodiment of the disclosure.

With reference now to the drawings, and in particular to FIGS. 1 through 6 thereof, a new illuminated handle device embodying the principles and concepts of an embodiment of the disclosure and generally designated by the reference numeral 10 will be described.

As best illustrated in FIGS. 1 through 6, the illuminated handle assembly 10 generally comprises a top handle 12 that has a top end 14 and a bottom end 16. The top handle 12 is elongated between the top 14 and bottom 16 ends. An outer surface 18 of the top handle 12 is threaded proximate the bottom end 16 of the top handle 12. The top end 14 of the top handle 12 insertably receives an arm 20 of a paint roller 22 so the top handle 12 is removably coupled to the paint roller 22. The paint roller 22 may be a paint roller of any conventional design.

A primary handle 24 has an upper end 26 and a lower end 28. The primary handle 24 is elongated between the upper 26 and lower 28 ends. The lower end 28 of the primary handle 24 is open. An outer wall 30 of the primary handle 24 is curvilinear so the primary handle 24 has a cylindrical shape. The outer wall 30 of the primary handle 24 flares outwardly between a lower section 32 and an upper section 34 of the primary handle 24. Moreover, the upper section 34 of the primary handle 24 has a diameter that is greater than a diameter of the lower section 32 of the primary handle 24. A crowning section 36 of the primary handle 24 has a diameter that is less than a diameter of the upper section 34 of the primary handle 24.

The upper end 26 of the primary handle 24 has a coupling well 38 extending downwardly therein. The coupling well 38 is centrally positioned on the upper end 26 of the primary handle 24. A bounding wall 40 of the coupling well 38 comprises a plurality of threads. The bottom end 16 of the top handle 12 threadably engages the bounding wall 40 of the coupling well 38 so the primary handle 24 is removably coupled to the top handle 12. The upper end 26 of the primary handle 24 has a light well 42 extending downwardly therein. Moreover, the light well 42 is positioned between the coupling well 38 and the outer wall 30 of the primary handle 24. The light well 42 is one of a plurality of the light wells 42 that is evenly spaced apart and distributed around an entire circumference of the coupling well 38.

A plurality of light emitters 44 is each positioned within an associated one of the plurality of light wells 42. The plurality of light emitters 44 selectively directs a beam of light upwardly toward the paint roller 22. Further, the plurality of light emitters 44 illuminates an area to be painted by the paint roller 22. Each of the plurality of light emitters 44 may be an LED of any conventional design.

A cap 46 is provided. The cap 46 has an exterior wall 48 coupled to and extending downwardly from an outer edge 50 of an uppermost wall 52 of the cap 46. The outer edge 50 of the uppermost wall 52 of the cap 46 is curved so the uppermost wall 52 of the cap 46 has a circular shape. A hole 54 extends through the uppermost wall 52 of the cap 46. The hole 54 is centrally positioned on the uppermost wall 52 of the cap 46.

The cap 46 is positionable on the upper end 26 of the primary handle 24 so a bottom surface 56 of the uppermost wall 52 of the cap 46 abuts the upper end 26 of the primary handle 24. The exterior wall 48 of the cap 46 abuts the outer wall 30 of the crowning section 36 of the primary handle 24. A bottom edge 58 of the cap 46 abuts a top edge 60 of the upper section 34 of the primary handle 24. Additionally, the hole 54 is aligned with the coupling well 38. The cap 46 may be comprised of a translucent material.

An extension handle 62 is provided. The extension handle 62 has a topmost end 64 and a bottommost end 66. An outermost surface 68 of the extension handle 62 is threaded proximate the topmost end 64 of the extension handle 62. The extension handle 62 has a telescopically adjustable length. Finally, the topmost end 64 of the extension handle 62 selectively threadably engages the lower end 28 of the primary handle 24.

An actuator 70 is coupled to the outer wall 30 of the primary handle 24. The actuator 70 is positioned on a medial section 72 of the primary handle 24. The outer wall 30 of the upper section 34 of the primary handle 24 has a plurality of power supply wells 74 extending therein. The plurality of power supply wells 74 is evenly spaced apart and distributed around an entire circumference of the upper section 34 of the primary handle 24.

A plurality of lower contacts 76 is each coupled to a bottom wall 78 of an associated one of each of the plurality of power supply wells 74. The plurality of lower contacts 76 is each electrically coupled to the actuator 70. A plurality of upper contacts 80 is coupled to a topmost wall 82 of an associated one of each of the plurality of power supply wells 74. The plurality of upper contacts 80 is each electrically coupled to an associated one of the plurality of light emitters 44. A plurality of lids 84 each removably covers an associated one of the plurality of power supply wells 74. The plurality of lids 84 hermetically seals the associated one of the plurality of power supply wells 74.

A power supply 86 is provided. The power supply 86 may comprise a battery 88. The power supply 86 is one of a plurality of the power supplies 86. Each of the plurality of power supplies 86 is positionable in an associated one of the plurality of power supply wells 74.

A negative end 90 of each of the plurality of power supplies 86 electrically engages an associated one the plurality of lower contacts 76. A positive end 92 of each of the plurality of power supplies 86 electrically engages an associated one of the plurality of upper contacts 80. Each of the plurality of power supplies 86 is electrically coupled between the actuator 70 and an associated one of the plurality of light emitters 44. The actuator 70 selectively actuates the plurality of light emitters 44.

In use, the actuator 70 is actuated when the area to be painted needs to be illuminated. The extension handle 62 is coupled to the primary handle 24 so the paint roller 22 may engage a point that is elevated beyond reach. The paint roller 22 is usable with or without use of the extension handle 62. The primary handle 24 is removed from the top handle 12 when the paint roller 22 is to be cleaned.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An illuminated handle assembly for attaching to a paint roller, said assembly comprising:

a top handle removably coupled to the paint roller;

a primary handle being coupled to said top handle such that said primary handle is coupled to the paint roller;

a plurality of light emitters each coupled to said primary handle such that said plurality of light emitters directs a beam of light toward said paint roller, each of said plurality of light emitters being operationally independent from one another; and an actuator coupled to said primary handle, said primary actuator being operationally coupled to each of said plurality of light emitters such that said actuator selectively actuates said plurality of light emitters.

2. The assembly according to claim 1, wherein said top handle having a top end and a bottom end, said top handle being elongated between said top and bottom ends, an outer surface of said top handle being threaded proximate said bottom end of said top handle.

3. The assembly according to claim 1, wherein a top end of said top handle insertably receiving an arm of the paint roller.

4. The assembly according to claim 1, wherein said primary handle having an upper end and a lower end, said primary handle being elongated between said upper and lower ends.

5. The assembly according to claim 1, wherein an outer wall of said primary handle being curvilinear such that said primary handle has a cylindrical shape.

6. The assembly according to claim 4, wherein said outer wall of said primary handle flaring outwardly between a lower section and an upper section of said primary handle such that said upper section of said primary handle has a diameter being greater than a diameter of said lower section of said primary handle.

7. The assembly according to claim 1, wherein an upper end of said primary handle having a coupling well extending downwardly therein, said coupling well being centrally positioned on said upper end of said primary handle.

8. The assembly according to claim 1, wherein an upper end of said primary handle having a light well extending downwardly therein such that said light well is positioned between a coupling well and an outer wall of said primary handle.

9. The assembly according to claim 8, wherein said light well being one of a plurality of light wells being evenly spaced apart and distributed around an entire circumference of said coupling well.

10. The assembly according to claim 1, wherein a bottom end of said top handle threadably engaging a coupling well such that said top handle is removably coupled to said primary handle.

11. The assembly according to claim 1, wherein each of said plurality of light emitters being positioned within an associated one of a plurality of light wells.

12. The assembly according to claim 1, wherein said actuator being coupled to an outer wall of said primary handle, said actuator being positioned on a medial section of said primary handle.

13. The assembly according to claim 1, wherein a power supply removably coupled to said primary handle.

14. The assembly according to claim 13, wherein said power supply being one of a plurality of said power supplies.

15. The assembly according to claim 14, wherein each of said plurality of power supplies being electrically coupled between said actuator and an associated one of said plurality of light emitters.

16. An illuminated handle assembly for attaching to a paint roller, said assembly comprising:

a top handle having a top end and a bottom end, said top handle being elongated between said top and bottom ends, an outer surface of said top handle being threaded proximate said bottom end of said top handle, said top end of said top handle insertably receiving an arm of the paint roller such that said top handle is removably coupled to the paint roller;

a primary handle having an upper end and a lower end, said primary handle being elongated between said upper and lower ends, an outer wall of said primary handle being curvilinear such that said primary handle has a cylindrical shape, said outer wall of said primary handle flaring outwardly between a lower section and an upper section of said primary handle such that said upper section of said primary handle has a diameter being greater than a diameter of said lower section of said primary handle;

said upper end of said primary handle having a coupling well extending downwardly therein, said coupling well being centrally positioned on said upper end of said primary handle, said bottom end of said top handle threadably engaging said coupling well such that said top handle is removably coupled to said primary handle;

said upper end of said primary handle having a light well extending downwardly therein such that said light well is positioned between said coupling well and said outer wall of said primary handle;

said light well being one of a plurality of said light wells being evenly spaced apart and distributed around an entire circumference of said coupling well;

a plurality of light emitters each positioned within an associated one of said plurality of light wells such that said plurality of light emitters directs a beam of light toward said paint roller;

an actuator coupled to said outer wall of said primary handle, said actuator being positioned on a medial section of said primary handle; and a power supply removably coupled to said primary handle, said power supply being one of a plurality of said power supplies, each of said plurality of power supplies being electrically coupled between said actuator and an associated one of said plurality of light emitters such that said actuator selectively actuates said plurality of light emitters.

* * * * *